US006422844B2

(12) United States Patent
Hioki et al.

(10) Patent No.: US 6,422,844 B2
(45) Date of Patent: Jul. 23, 2002

(54) SCREW COMPRESSOR

(75) Inventors: Yasuhiro Hioki, Shizuoka; Shigekazu Nozawa, Shimizu, both of (JP)

(73) Assignee: Hitachi Air Conditioning Systems Co., Ltd., Tokyo (JP); Hitachi, Ltd., trustee ( * ) Notice: Subject to any disclaimer, the term of this patent is extended or adjusted under 35 U.S.C. 154(b) by 0 days.

(21) Appl. No.: 09/749,403

(22) Filed: Dec. 28, 2000

(30) Foreign Application Priority Data

Apr. 28, 2000 (JP) ..... 2000-134198

(51) Int. Cl.[7] ..... F03C 2/00

(52) U.S. Cl. ..... 418/98; 418/91; 418/94; 418/201.1

(58) Field of Search ..... 418/91, 94, 98, 418/201.1

(56) References Cited

U.S. PATENT DOCUMENTS 5,397,223 A * 3/1995 Spinnler et al. ..... 418/94
6,183,227 B1 * 2/2001 Jida et al. ..... 418/55.6

FOREIGN PATENT DOCUMENTS

JP 54-154811 * 12/1979 ..... 418/94
JP 59-115492 * 7/1984 ..... 418/94
JP 59-215985 * 12/1984 ..... 418/98
JP 60-249693 * 12/1985 ..... 418/76
JP 61-272488 * 12/1986 ..... 418/94
JP 05-010283 * 1/1993 ..... 418/201.1

OTHER PUBLICATIONS

Japanese Patent Unexamined Publication No. 5–113184.*

* cited by examiner

*Primary Examiner*—Thomas Denion
*Assistant Examiner*—Theresa Trieu
(74) *Attorney, Agent, or Firm*—Antonelli, Terry, Stout & Kraus, LLP

(57) ABSTRACT

To prevent a decrease in capacity of a compressor, and to decrease the quantity of oil contained in discharged gas, and to decrease the quantity of oil discharged to an outside of the compressor. In a screw compressor in which a screw rotor is supported by a low-pressure side bearing and a high-pressure side bearing in a rotor casing and the screw rotor and a driving motor are connected to each other by a coupling, and a drain oil passage is provided to return oil having lubricated the high-pressure side bearing to a low-pressure gas suction side through a through hole formed in a center of the screw rotor, a throttle mechanism is provided in the drain oil passage to inject the oil.

6 Claims, 4 Drawing Sheets

SCREW COMPRESSOR

BACKGROUND OF THE INVENTION

The present invention relates to a hermetic screw compressor used for refrigeration and air conditioning and, more particularly, to a hermetic screw compressor suitable for a high-capacity refrigerator.

Conventionally, there has been known a hermetic screw compressor in which a screw rotor shaft is connected to a driving motor shaft with a coupling and the screw rotor shaft is supported by a high-pressure side bearing and a low-pressure side bearing, in which oil having been used for the lubrication of the high-pressure side bearing is caused to directly flow into a through hole formed in the center of the screw rotor shaft, being discharged as it is, and after being used for the lubrication of the coupling, the oil is mixed with low-pressure gas and is sucked in a tooth space portion of male and female rotors. The screw compressor of this type has been described in JP-A-5-113184 specification.

In the above-described prior art, the oil fed to the bearing has a high pressure and high temperature, and after the bearing and the gear coupling have been lubricated, all the oil is discharged to a low-pressure gas suction side, so that sucked gas is overheated and expanded. Also, there is a fear that a refrigerant contained in the lubricating oil is gasified, and the normal sucked gas quantity decreases, so that the compression function decreases. Further, if the discharge quantity of oil supplied for sealing to prevent compressed gas from leaking from the a rotor dedendum shaft portion to the bearing side is large, a shortage of oil occurs, and the sealing effect decreases, so that the compression function decreases. Further, if the quantity of oil discharged to the suction side is large, the quantity of oil sucked to the tooth space portion of male and female rotors increases, so that the quantity of oil contained in discharged gas increases.

BRIEF SUMMARY OF THE INVENTION

The present invention has been achieved to solve the above problems, and accordingly an object thereof is to prevent a decrease in capacity of a compressor, decrease the quantity of oil contained in discharged gas, and decrease the quantity of oil discharged to the outside of the compressor.

To solve the above problems, the present invention provides a screw compressor in which a screw rotor is supported by a low-pressure side bearing and a high-pressure side bearing in a rotor casing, and the screw rotor and a driving motor are connected to each other by a coupling, and a drain oil passage is provided to return oil having lubricated the high-pressure side bearing to the low-pressure gas suction side through a through hole formed in the center of the screw rotor, wherein a throttle mechanism is provided in the drain oil passage to inject the oil.

Thus, since oil is injected by the throttle mechanism in the drain oil passage, the quantity of oil returning to the low-pressure gas suction side decreases, the sealing effect of the screw rotor section is improved, and the leakage amount decreases. Also, since the injected oil swirls with the rotation of the screw rotor, the cooling of oil is promoted, the overheating and expansion of sucked gas caused by oil and the gasification of a refrigerant contained in lubricating oil are reduced, the quantity of discharged gas is larger than the quantity of sucked gas, that is, the volume efficiency can be enhanced, and the suction amount at the time of gas suction decreases, so that the quantity of oil contained in discharged gas (discharge quantity of oil) can be decreased.

Also, in the above-described screw compressor, a member formed with a minute circular hole at the inlet of the drain oil passage can preferably be attached as a throttle mechanism.

Further, in the above-described screw compressor, the oil inlet side of the through hole preferably has a diameter smaller than the diameter of the through hole.

Further, the present invention provides a screw compressor in which a screw rotor is supported by a low-pressure side bearing and a high-pressure side bearing in a rotor casing, and the screw rotor and a driving motor are connected to each other by a coupling, in which oil for lubrication and cooling is fed from an oil sump provided in a high-pressure portion in the rotor casing to the high-pressure side bearing through an oil passage, flows into a drain oil passage formed in the screw rotor, is injected by being throttled at the inlet of the drain oil passage, is swirled with the rotation of the screw rotor, and thereafter lubricates the coupling.

Also, in the above-described screw compressor, a member for injecting oil at the inlet of the drain oil passage can preferably be attached to the screw rotor.

Further, the present invention provides a screw compressor in which a screw rotor is supported by a low-pressure side bearing and a high-pressure side bearing in a rotor casing, and the screw rotor and a driving motor are connected to each other by a coupling, wherein the screw compressor comprises an oil sump communicating with a high-pressure portion in the rotor casing, an oil passage connecting the oil sump to the high-pressure side bearing, a drain oil passage formed in the screw rotor, and a minute circular hole formed at the inlet of the drain oil passage to inject oil.

Also, in the above-described screw compressor, the minute circular hole is formed in a member which can be attached to the screw rotor.

Further, the present invention provides a screw compressor in which a screw rotor is supported by a low-pressure side bearing and a high-pressure side bearing in a rotor casing, and the screw rotor and a driving motor are connected to each other by a coupling, wherein oil for lubrication and cooling is injected through a throttle mechanism formed in the screw rotor to cool the screw rotor.

DETAILED DESCRIPTION OF PREFERRED EMBODIMENTS

One embodiment of the present invention will now be described with reference to FIGS. 1 to 4.

Figure 1:
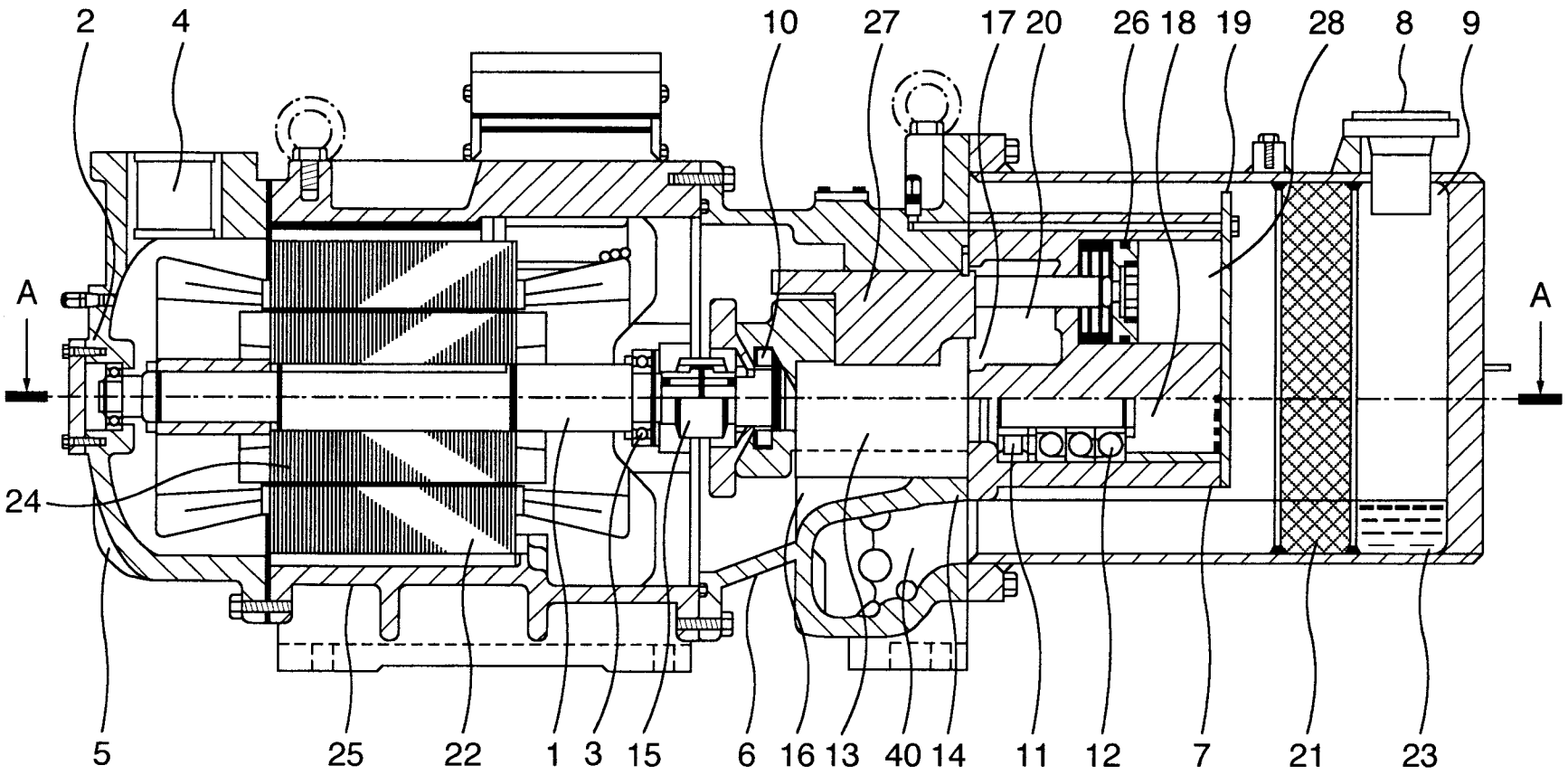
FIG. 1 is a sectional view of one embodiment in accordance with the present invention.
Figure 2:
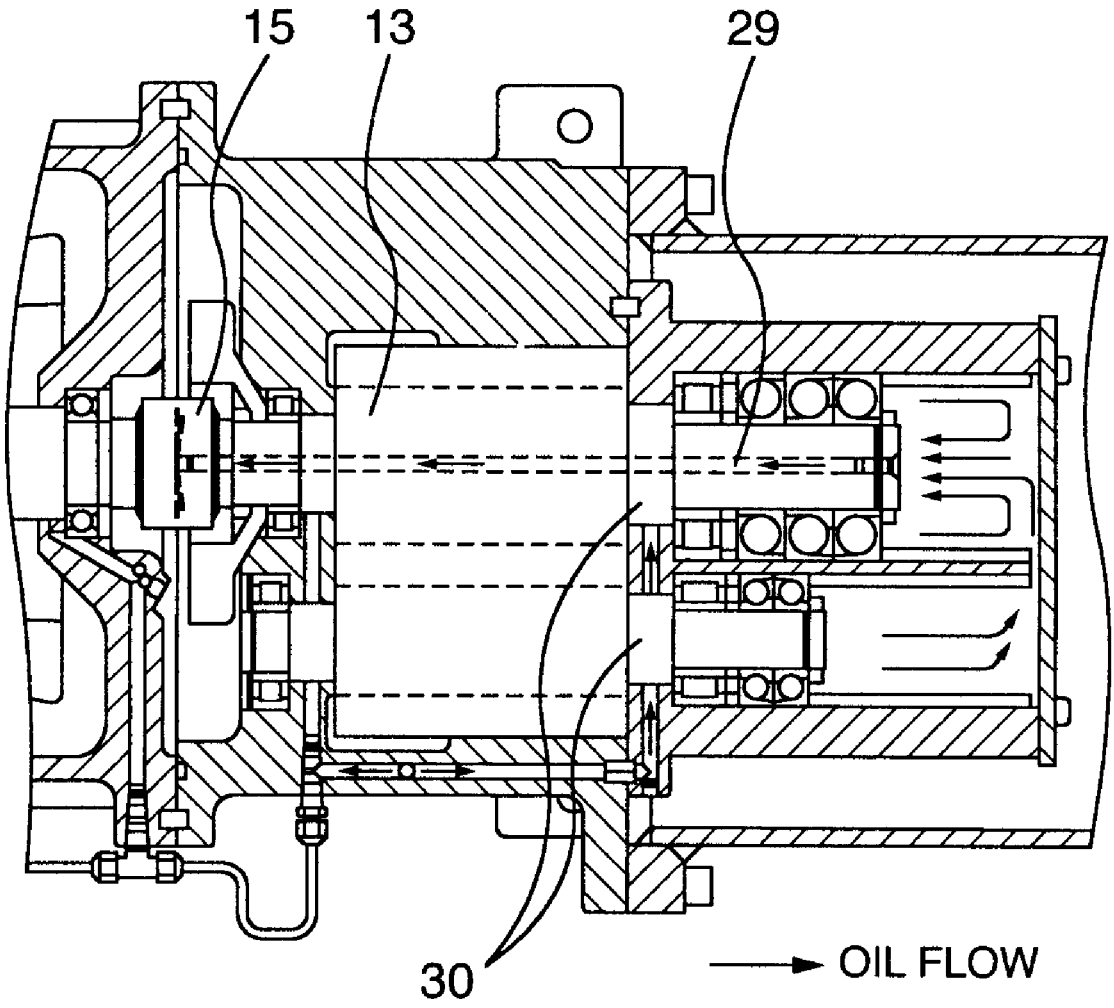
FIG. 2 is a horizontal sectional view taken along a line A—A of a high-pressure side bearing chamber shown in FIG. 1.
Figure 3:
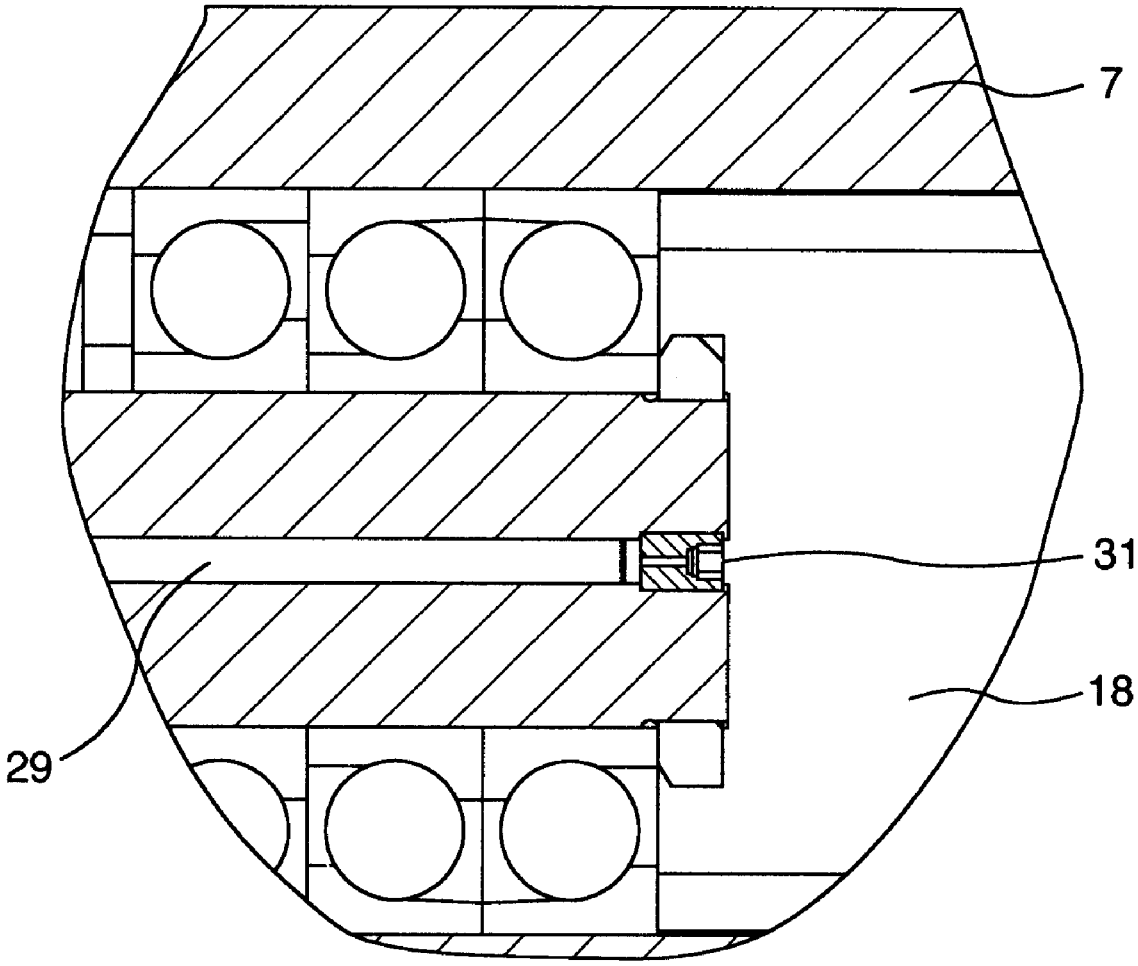
FIG. 3 is a partial detailed view of a drain oil passage shown in FIG. 2.
Figure 4:
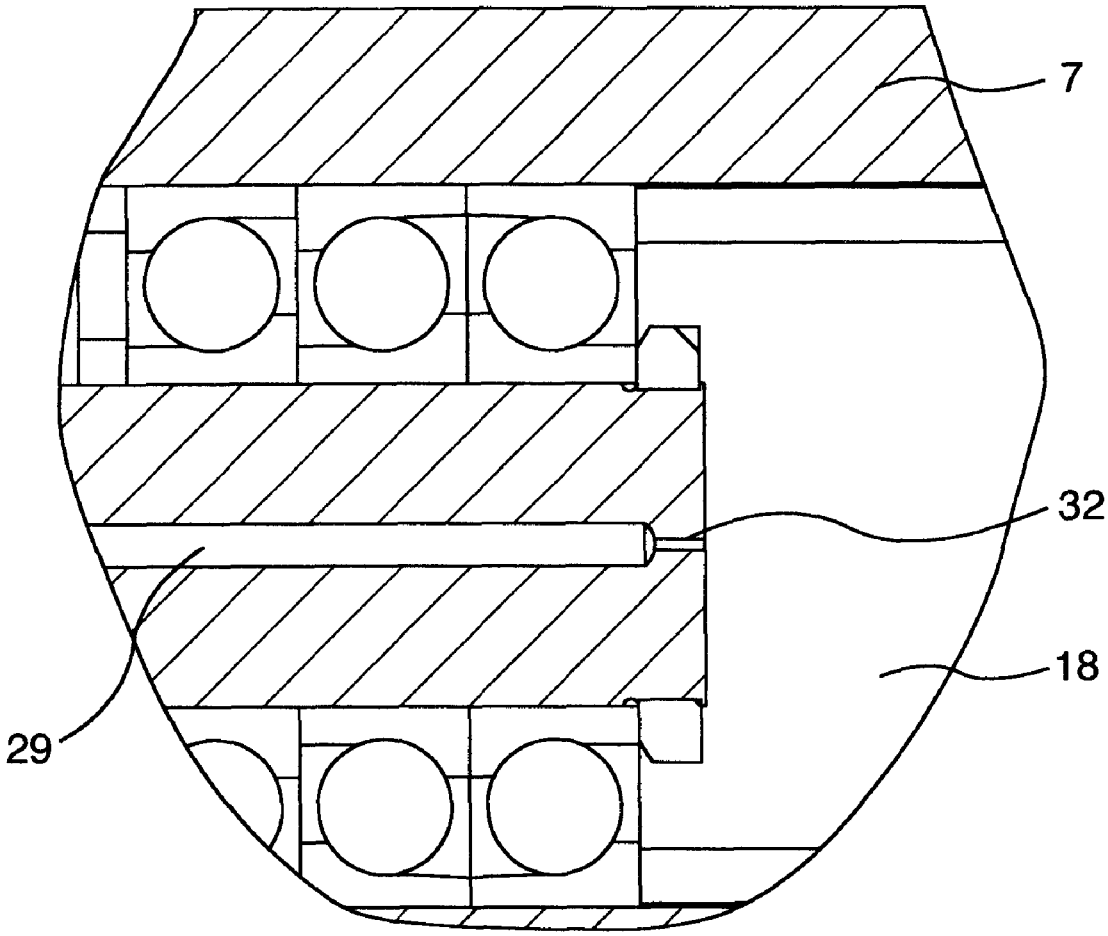
FIG. 4 is a partial detailed view of a drain oil passage in accordance with another embodiment.

FIG. 1 is a sectional view of a screw compressor in accordance with one embodiment of the present invention, and FIG. 2 is a horizontal sectional view taken along a line A—A of a high-pressure side bearing chamber shown in FIG. 1, in which the arrow mark indicates the direction of oil flow. FIG. 3 is a partial detailed view of a drain oil passage in accordance with one embodiment, and FIG. 4 is a partial detailed view of a drain oil passage in accordance with another embodiment.

The screw compressor shown in FIG. 1 is broadly divided into an electric motor section, a screw rotor section, and a discharge section. A gas to be compressed flows from the electric motor section to the discharge section through the screw rotor, and is discharged from the discharge section to the outside of compressor. In the following description, directions are indicated so that the electric motor side is taken as the upstream side, and the discharge section side is taken as the downstream side.

The electric motor section includes a bell-shaped suction cover 5 having a bearing 2 and a suction port 4 and a motor casing 25 which is connected to the suction cover 5 and incorporates a driving electric motor 22. A motor shaft 1 of the driving electric motor 22 is supported by a bearing 2 at the upstream-side end thereof and is supported by a bearing 3 at the downstream-side end thereof, and the bearing 3 is attached to the downstream-side end of the motor casing 25. A stator of the driving electric motor 22 is mounted in the motor casing 25, and an air gap is formed between the stator and a motor rotor 24 fixed to the motor shaft 1.

The screw rotor section includes a rotor casing 6 connected concentrically to the end (downstream-side end) on the side of the bearing 3 of the motor casing 25 and a pair of a male rotor 13 and a female rotor (not shown), which are screw rotors housed in a cylindrical bore 14 formed in the rotor casing 6 and meshed with each other.

The paired male rotor 13 and female rotor are supported by a bearing 10 whose upstream-side end is installed to the rotor casing 6, and the shaft of the male rotor 13 is connected to the motor shaft 1 via a coupling 15. Also, a suction port 16 for introducing a refrigerant gas (hereinafter referred to as a gas) to be compressed into the cylindrical bore 14 is formed, and a discharge port 17 serving as an outlet for the gas compressed by the male and female rotors is formed at the end (downstream-side end) on the opposite side of the suction port 16. The rotor casing 6 incorporates a slide valve 27. At the bottom of the rotor casing 6, an oil sump 40 communicating with an oil reservoir at the bottom of a discharge chamber 9 is formed so as to be isolated from the suction port 16 and the cylindrical bore 14.

The downstream-side end of the rotor casing 6 is connected to the rotor casing 6 so that the axes thereof are in parallel. The discharge section includes a discharge casing 7 having a bearing chamber 18 incorporating a roller bearing 11 and a ball bearing 12, a piston 26 for driving the slide valve 27, and the discharge chamber 9 for covering a shield plate 19 for closing the downstream-side end of the discharge casing 7 and the discharge casing 7.

The bearing chamber 18 communicates with the coupling 15 located on the low pressure gas suction side by means of a through hole formed in the shaft center of the male rotor 13 (hereinafter referred to as a drain oil passage 29). At the inlet of the drain oil passage 29 is installed a member provided with a throttle mechanism (plug 31) as shown in FIG. 3. Oil is injected by the plug 31, and then the flow thereof is swirled with the rotation of the male rotor 13.

The discharge chamber 9, constituting a flow path for the compressed gas, is disposed so that the axis of gas flow is substantially horizontal. The shield plate 19 closes not only the bearing chamber 18 but also the end of a cylinder 28 in which the piston 26 is housed. The downstream side of the shaft of the paired male rotor 13 and female rotor is supported on the roller bearing 11 and the ball bearing 12.

The discharge casing 7 is fixed to the rotor casing 6 by using bolts or other means. The discharge chamber 9 is fixed to the rotor casing 6 by using bolts or other means so as to surround the discharge casing 7. The discharge casing 7 is formed with a gas discharge path 20 communicating with the cylindrical bore 14 via the discharge port 17, and the outlet thereof is open into the discharge chamber 9. At the bottom of the discharge chamber 9 is formed an oil reservoir that stores lubricating oil 23, the oil reservoir communicating with an oil sump 40 at the bottom of the rotor casing 6. An oil feed passage formed in the rotor casing 6 and the discharge casing 7 communicates with the oil sump 40 and each of the bearings.

The suction cover 5, the motor casing 25, the rotor casing 6, and the discharge chamber 9 are connected to each other so that the connecting portion therebetween is gastight.

The following is a description of the flow of gas and oil.

A low-temperature and low-pressure gas sucked through the suction port 4 provided in the suction cover 5 passes through a gas passage provided between the driving electric motor 22 and the motor casing 25 and the air gap between the stator and the motor rotor, and after cooling the driving electric motor 22, it is sucked into a compression chamber formed by a male and female screw rotor meshing tooth flank and the casing through the suction port 16 formed in the rotor casing 6. Subsequently, the gas is sucked into the compression chamber formed by the male and female screw rotor meshing tooth flank and the rotor casing 6 with the rotation of the male rotor 13 connected to the driving electric motor 22 by the coupling 15. The gas having been sucked into the compression chamber is sealed up in the compression chamber with the rotation of the male rotor 13 and gradually compressed with the decrease in compression chamber due to the rotation of the male and female screw rotors, thereby becoming a high-temperature and high-pressure gas. The high-temperature and high-pressure gas is introduced to a discharge path 20 through the discharge port 17 formed in the discharge casing 7, and is discharged into the discharge chamber 9.

Of the compression reaction forces acting on the male and female screw rotors at the time of compression, a radial load is supported by the roller bearing 11, and a thrust load is supported by the ball bearing 12. The oil for lubricating and cooling the bearings is fed by a pressure difference from the oil sump 40 provided in the high-pressure portion in the rotor casing 6 through an oil passage communicating with the bearings. When the oil fed to the high-pressure side bearing of the male and female rotors flows into the drain oil passage 29 formed in the shaft center of the male rotor 13, it is injected by the throttle mechanism formed at the inlet of the passage, so that the quantity of oil is decreased. Thereafter, the oil lubricates the coupling 15 while being cooled by the flow of oil swirled with the rotation of the male rotor 13, and then is discharged to the suction side, where the oil is mixed with the low-pressure gas and is sucked into the tooth space portion of the male and female rotors, and thereafter is discharged into the discharge chamber 9 together with the compressed gas. Also, the oil contained in the compressed gas passes through a demister 21 in the discharge chamber 9 to separate oil in the discharged gas. The separated oil is accumulated in the oil sump 40 at the lower part of the rotor casing 6. After the oil is separated, the compressed refrigerant gas is discharged through a discharge port 8, and suction inhibiting factors such as overheat of sucked gas due to oil and gasification of refrigerant from oil are reduced. Further, since the quantity of sucked oil at the time of gas suction decreases, the quantity of oil contained in the discharged gas also decreases.

FIG. 4 shows another embodiment, in which a minute circular hole 32 is directly formed at the inlet of the drain oil passage 29.

According to this embodiment, when the high-temperature and high-pressure oil is returned to the suction side after lubricating the high-pressure side bearing, the oil is injected by the throttle construction at the inlet of the drain oil passage, the oil flow is swirled while the oil quantity is decreased, the overheat and expansion of sucked gas and the gasification of refrigerant contained in lubricating oil are reduced by the cooling of oil, the sealing effect due to oil in the portion of a rotor dedendum shaft 30 is improved by decreasing the quantity of drain oil, and the leakage amount can be decreased. Also, since the quantity of oil sucked at the time of gas suction can be decreased, the quantity of oil discharged to the outside of compressor can be decreased.

According to the present invention, there can be provided a screw compressor in which a decrease in capacity of compressor can be prevented, the quantity of oil contained in the discharged gas can be decreased, and the quantity of oil discharged to the outside of compressor can be decreased.

What is claimed is:

1. A screw compressor in which a screw rotor is supported by a low-pressure side bearing and a high-pressure side bearing in a rotor casing, said screw rotor and a driving motor are connected to each other by a coupling, and a drain oil passage is provided to return oil having lubricated said high-pressure side bearing to the low-pressure gas suction side through a through hole formed in the center of said screw rotor, wherein a throttle mechanism is provided in said drain oil passage to inject said oil, wherein a member formed with a minute circular hole at an inlet of said drain oil passage can be attached as a throttle mechanism.

2. A screw compressor in which a screw rotor is supported by a low-pressure side bearing and a high-pressure side bearing in a rotor casing, said screw rotor and a driving motor are connected to each other by a coupling, and a drain oil passage is provided to return oil having lubricated said high-pressure side bearing to the low-pressure gas suction side through a through hole formed in the center of said screw rotor, wherein a throttle mechanism is provided in said drain oil passage to inject said oil, wherein an oil inlet side of said through hole has a diameter smaller than the diameter of said through hole.

3. A screw compressor in which a screw rotor is supported by a low-pressure side bearing and a high-pressure side bearing in a rotor casing, and said screw rotor and a driving motor are connected to each other by a coupling, wherein oil for lubrication and cooling is fed from an oil sump provided in a high-pressure portion in said rotor casing to said high-pressure side bearing through an oil passage, flows into a drain oil passage formed in said screw rotor, is injected by being throttled at an inlet of said drain oil passage, is swirled with the rotation of said screw rotor, and thereafter lubricates said coupling.

4. The screw compressor according to claim 3, wherein a member for injecting oil at the inlet of said drain oil passage can be attached to said screw rotor.

5. A screw compressor in which a screw rotor is supported by a low-pressure side bearing and a high-pressure side bearing in a rotor casing, and said screw rotor and a driving motor are connected to each other by a coupling, comprising:

an oil sump communicating with a high-pressure portion in said rotor casing;

an oil passage connecting said oil sump to said high-pressure side bearing;

a drain oil passage formed in said screw rotor; and a minute circular hole formed at an inlet of said drain oil passage to inject oil.

6. The screw compressor according to claim 5, wherein said minute circular hole is formed in a member which can be attached to said screw rotor.

* * * * *